US006540116B1

(12) United States Patent
Petitjean et al.

(10) Patent No.: US 6,540,116 B1
(45) Date of Patent: Apr. 1, 2003

(54) LIQUID DISPENSER HAVING A TWO-PART BODY

(75) Inventors: Maurice Petitjean, Florenville (BE); Pascal Hennemann, Eu (FR); David Leuliet, Mers-les-Bains (FR)

(73) Assignee: Rexam Sofab, La Treport (FR)

( * ) Notice: Subject to any disclaimer, the term of this patent is extended or adjusted under 35 U.S.C. 154(b) by 0 days.

(21) Appl. No.: 10/030,275

(22) PCT Filed: Jul. 7, 2000

(86) PCT No.: PCT/FR00/01968

§ 371 (c)(1),
(2), (4) Date: Jan. 7, 2002

(87) PCT Pub. No.: WO01/03850

PCT Pub. Date: Jan. 18, 2001

(30) Foreign Application Priority Data

Jul. 9, 1999 (FR) ..... 99 08917

(51) Int. Cl.[7] ..... B67D 5/40
(52) U.S. Cl. ..... 222/321.7; 222/382
(58) Field of Search ..... 222/321.1, 321.2, 222/321.7, 321.9, 381, 382

(56) References Cited

U.S. PATENT DOCUMENTS

| | | | | |
|---|---|---|---|---|
| 3,187,960 A | | 6/1965 | Gorman | 222/321 |
| 3,949,910 A | | 4/1976 | Focht | 222/321 |
| 3,991,914 A | | 11/1976 | Kotuby et al. | 222/321 |
| 5,692,649 A | * | 12/1997 | Schwab | 141/65 |
| 5,813,571 A | * | 9/1998 | Gaucher | 222/105 |
| 6,412,659 B1 | * | 7/2002 | Kneer | 222/105 |
| 6,415,962 B1 | * | 7/2002 | Bougamont et al. | 222/321.7 |

FOREIGN PATENT DOCUMENTS

| | | |
|---|---|---|
| DE | 2712383 | 9/1978 |
| EP | 0390717 | 2/1990 |
| EP | 0453357 | 4/1991 |
| EP | 0571280 | 5/1993 |
| EP | 0769328 | 10/1996 |

* cited by examiner

*Primary Examiner*—Joseph A. Kaufman
(74) *Attorney, Agent, or Firm*—Ladas & Parry

(57) ABSTRACT

The invention provides a dispenser for dispensing liquids from a receptacle, the dispenser having a cylindrical and conical body containing a measuring chamber closed at its bottom end by an admission valve and at its top end by a piston provided with a delivery valve and a delivery tube capped by a pushbutton, the body being the result of assembling together two independent elements: a top element carrying the piston and provided with a cylindrical skirt; and a bottom element provided with a sleeve for co-operating with the skirt by leaktight radial clamping so as to define the wall of the measuring chamber, the bottom element being provided with a bushing extending the sleeve coaxially downwards and engaged with leaktight radial clamping inside the neck of the receptacle.

11 Claims, 8 Drawing Sheets

LIQUID DISPENSER HAVING A TWO-PART BODY

Figure 1:
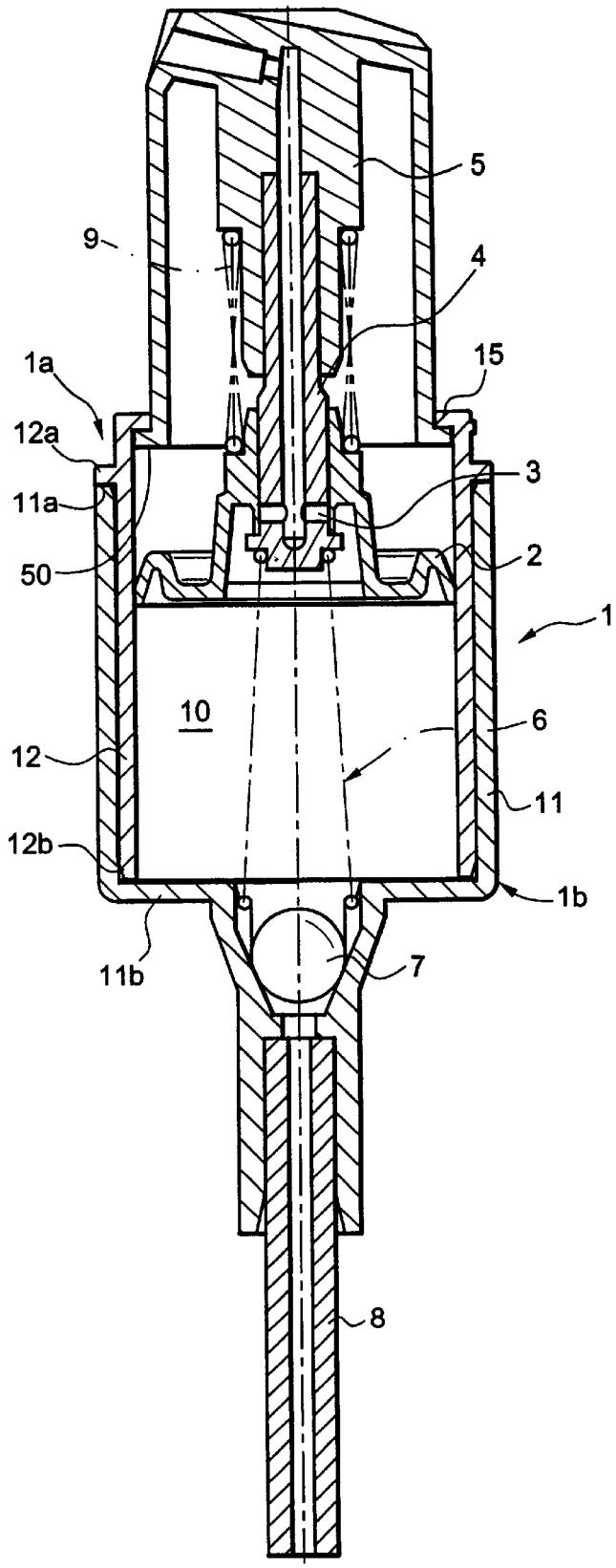

The present invention relates to a dispenser for dispensing liquid from a receptacle, and more particularly it relates to a miniature pump for delivering samples of perfumes or cosmetics or very small doses of pharmaceuticals, for example.

BACKGROUND ART

Miniature dispensers as described and shown in EP-A-0 453 357 comprise in particular a cylindrical and conical body enclosing a metering chamber closed at its bottom end by an admission valve and in its top portion by a piston provided with a delivery valve, and a delivery tube capped by a pushbutton.

Nevertheless, in conventional bodies that are made as a single piece, the piston is generally inserted into the chamber through the top opening and is then pushed downwards into the chamber, thereby giving rise to upward remanent deformation of the peripheral edge of the piston.

Unfortunately, this poor disposition of the edge of the piston is very difficult to correct after assembly, and if it is not corrected it runs the risk of causing the piston to jam and also of allowing liquid to leak out.

Furthermore, the pushbutton is held on the dispenser merely by being engaged on the delivery tube, which does not give it very great stability and which does not suffice to keep it in place when subjected to accidental stresses.

In addition, in traditional dispensers, the body must be sufficiently flexible to guarantee good sealing and proper operation of the valves, but it must also be sufficiently rigid to enable it to withstand temperature and aging well, particularly in the contact zone between the piston and the wall of the chamber. These constraints imposed on the material constituting the body determine the regularity and the constancy of the successive quantities of liquid that are dispensed.

Furthermore, it may be necessary to raise the body relative to the neck, which is either not possible with dispensers of the above type, or else leads to discontinuities in appearance.

SUMMARY OF THE INVENTION

An object of the invention is to resolve these technical problems in satisfactory manner.

According to the invention, this object is achieved by means of a dispenser of the above type in which said bottom element provided with a sleeve for co-operating with said skirt by leaktight radial clamping to define the wall of said measuring chamber, the dispenser being characterized in that said bottom element is provided with a bushing extending said sleeve coaxially downwards for engaging with leaktight radial clamping inside the neck of the receptacle.

In a particular embodiment, said skirt is engaged inside said sleeve.

Preferably, the bottom edge of said skirt comes into contact with the inside wall of said sleeve.

According to an advantageous characteristic, said skirt carries a shoulder forming an abutment for the top edge of said sleeve.

According to another characteristic, the inside wall of said skirt carries a radial projection for retaining the piston and/or the pushbutton.

In a particular embodiment, the admission valve is carried by the bottom element being provided at the bottom portion of said sleeve.

In a variant, said sleeve or said skirt carries a support and fixing collar on the neck of the receptacle.

In another variant, said collar is provided with screw-fastening or snap-fastening members for cooperating with complementary members of the receptacle.

The dispenser of the invention possesses a body made up of two elements that are made separately in independent form and that are designed to be assembled together either directly on the manufacturing site or else subsequently on the site where a product is packaged.

This concept makes a wide range of different functions, materials, and/or hardnesses available respectively for the top element and for the bottom element which can now be associated in a single dispenser, thus making it possible to optimize performance and in particular to optimize the quality and the reliability of dispensing.

In addition, the dispenser can be mounted on a receptacle move easily and in more diverse manners, thus enabling appearance to be improved without compromising leaktightness.

Finally, this disposition makes it possible firstly to introduce the piston from below into the top element, i.e. in compliance with its functional orientation, and secondly to retain both said piston and the pushbutton in an upward direction by using means that are simple and compatible with the return forces produced by a spring if any.

BRIEF DESCRIPTION OF THE DRAWING FIGURES

Figure 5:
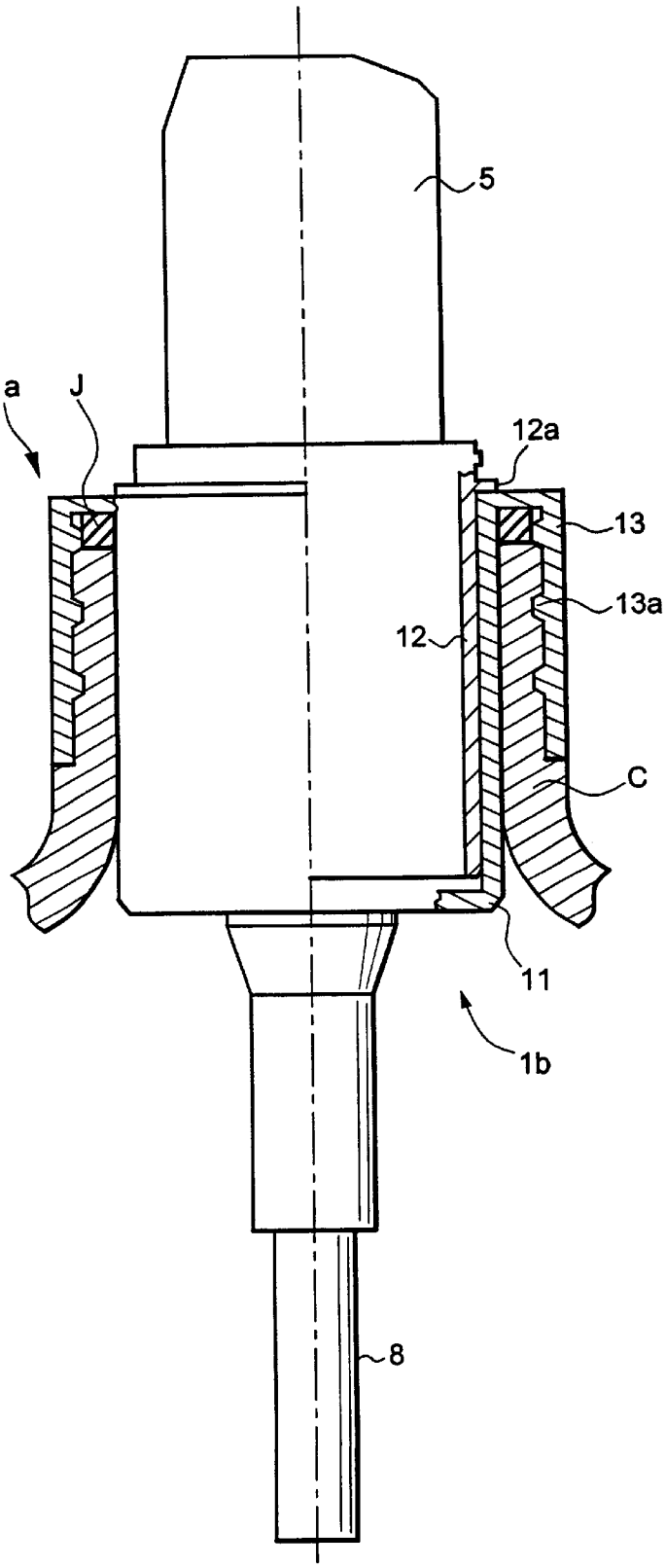
Figure 6:
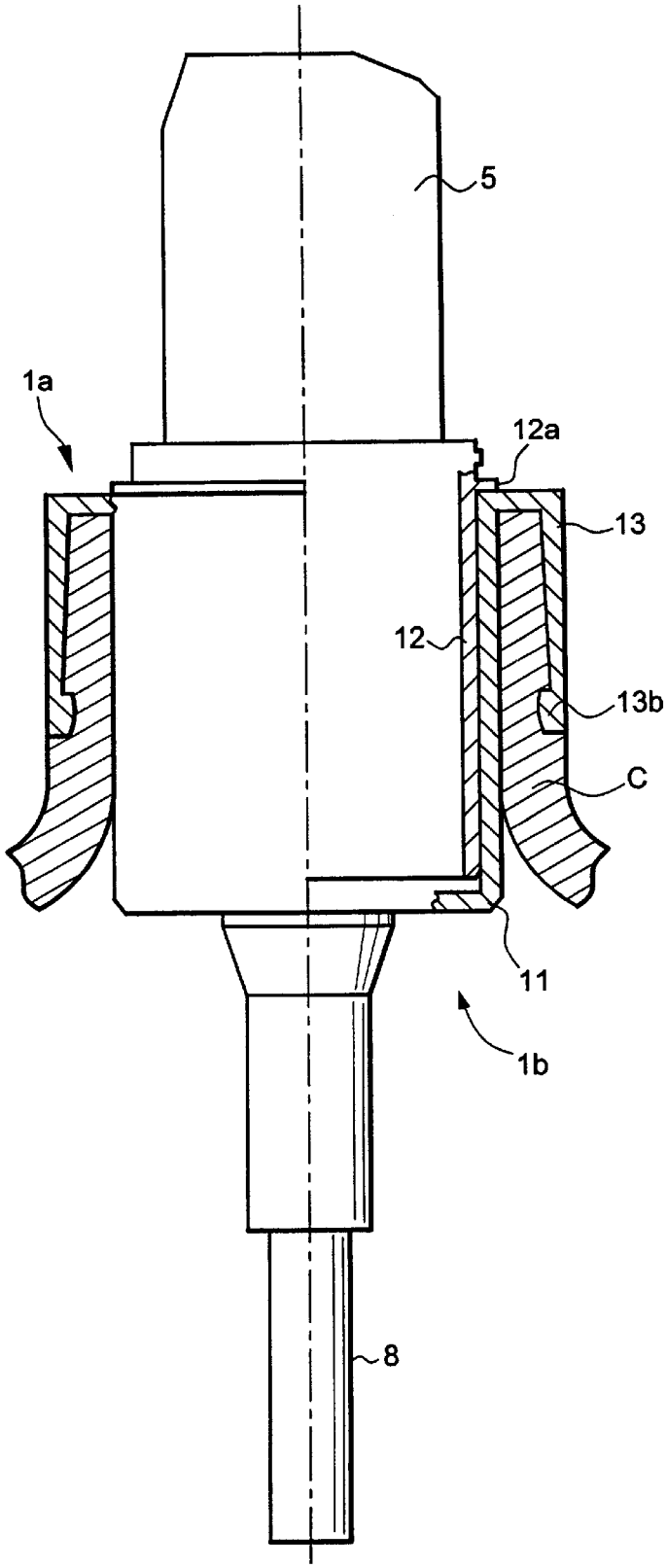
Figure 7:
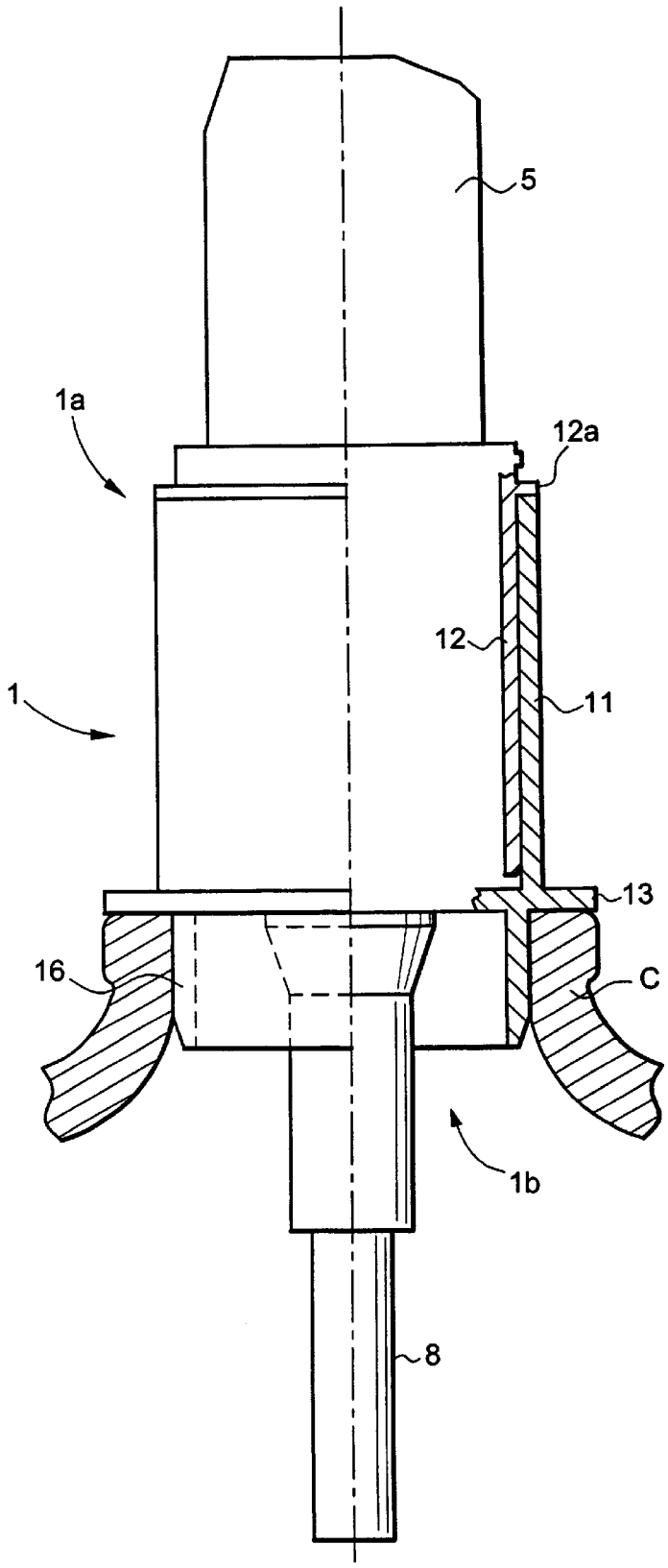
Figure 8:
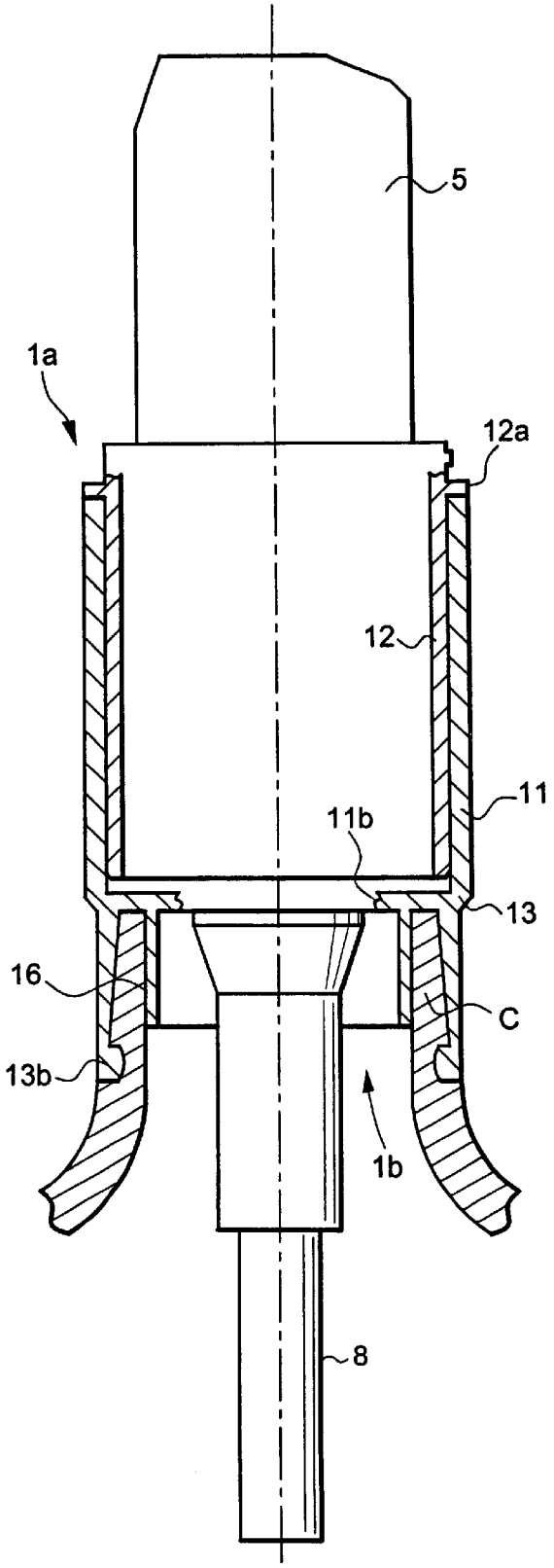

The invention will beg better understood on reading the following description made with reference to the accompanying drawings, in which:

FIGS. 1 to 6 are fragmentary section views of various embodiments of the dispenser in pump-type applications for receptacles which are used to understand the invention; and FIGS. 7 and 8 are fragmentary section views of two embodiments of the invention.

DETAILED DESCRIPTION OF THE PREFERRED EMBODIMENT

The dispenser shown in FIG. 1 comprises a cylindrical and conical body 1 containing a chamber 10 whose volume corresponds in this case to one measured unit of liquid.

The chamber 10 is closed on top by a piston 2 provided with a delivery valve 3 and a delivery tube 4 capped by a pushbutton 5 co-operating with an outer spring 9 mounted coaxially around the tube 4. An inner spring 6 (shown in chain-dotted lines) serves to return the piston 2 to its high position.

Nevertheless, this spring is not always necessary, and in some applications of the invention it can be advantageous to omit the inner spring 6 and retain only the outer spring 9.

In this embodiment which corresponds to a pump-type application, the bottom portion of the chamber 10 is fitted with an admission ball valve 7 suitable for communicating via a dip tube 8 with a receptacle (not shown in the figure) containing the liquid. Under such circumstances, the liquid remains inside the chamber 10 only temporarily.

The body 1 comprises two independent elements 1*a* and 1*b* designed to be assembled together in leaktight and optionally reversible manner.

To this end, the top element 1*a* which carries the piston 2 is provided with a cylindrical skirt 12 while the bottom element 1*b* is provided with a sleeve 11 for co-operating with the skirt 12 by radial clamping, thus defining the wall of the chamber 10.

In the embodiments of FIG. 1 and of FIGS. 2 to 8, the skirt 12 is always engaged inside the sleeve 11, however it is possible within the invention to provide for the converse engagement of the sleeve 11 inside the skirt 12.

The respective diameters and thicknesses of the skirt 12 and of the sleeve 11 are adjusted so that the radial clamping is leaktight and provides an assembled connection that is stable over time.

At the end of engagement, the bottom edge 12*b* of the skirt 12 preferably comes into contact with the inside wall of the sleeve 11 against a bottom 11*b*.

In order to facilitate insertion of the skirt 12 into the sleeve 11, the bottom edge 12*b* is chamfered.

The final assembled position is obtained when the top edge 11*a* of the sleeve 11 comes into abutment against a shoulder 12*a* formed at the top of the skirt 12.

At its top end, the inside wall of the skirt 12 carries a radial projection 15 co-operating with a flange 50 secured to the bottom portion of the pushbutton 5 so as to ensure that it is retained in an upward direction.

The projection 15 extends around the periphery, possibly discontinuously, and it also serves to hold the piston 2 inside the chamber 10 in contact with the inside wall of the skirt 12.

This disposition implies that the piston 2 and the pushbutton 5 are inserted into the skirt 12 through its bottom opening of larger diameter.

Figure 2:
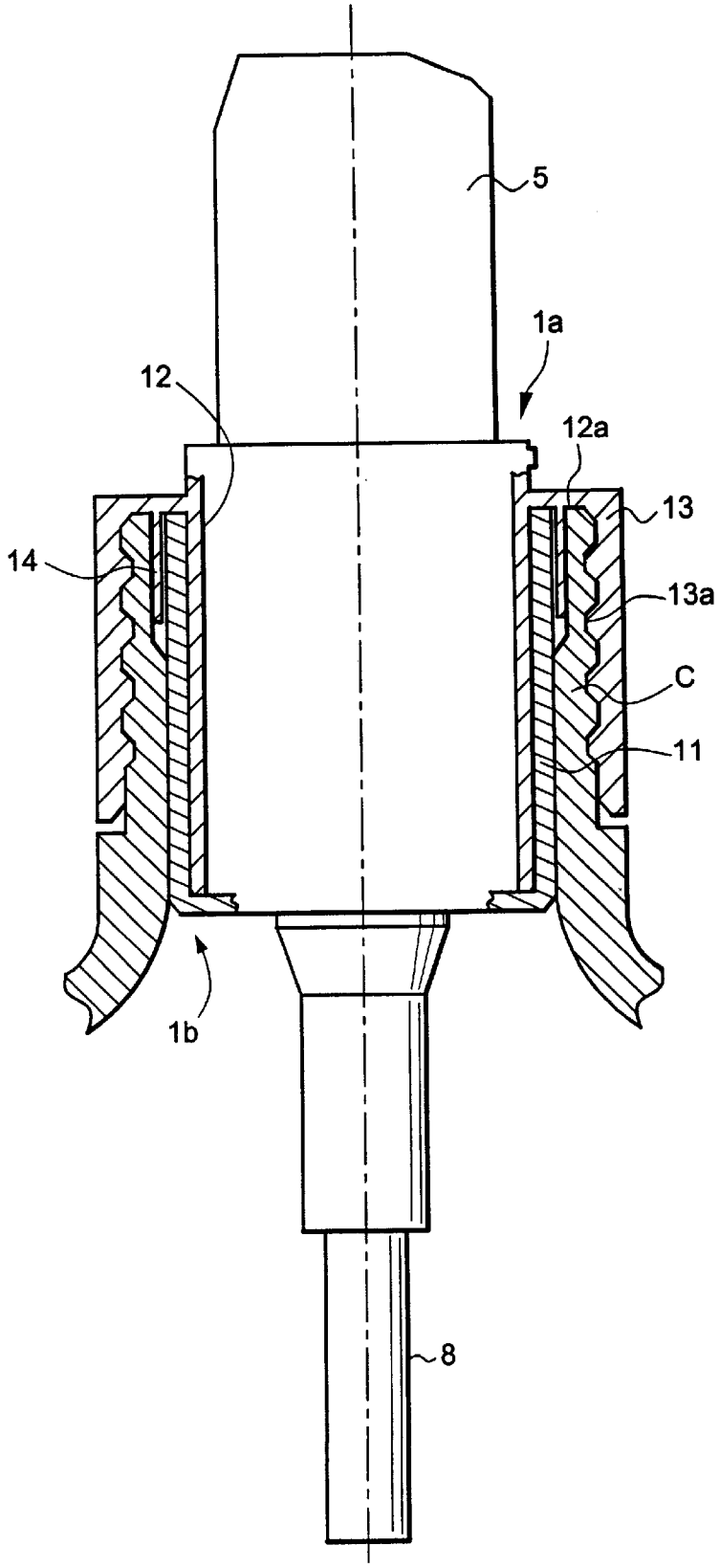
Figure 3:
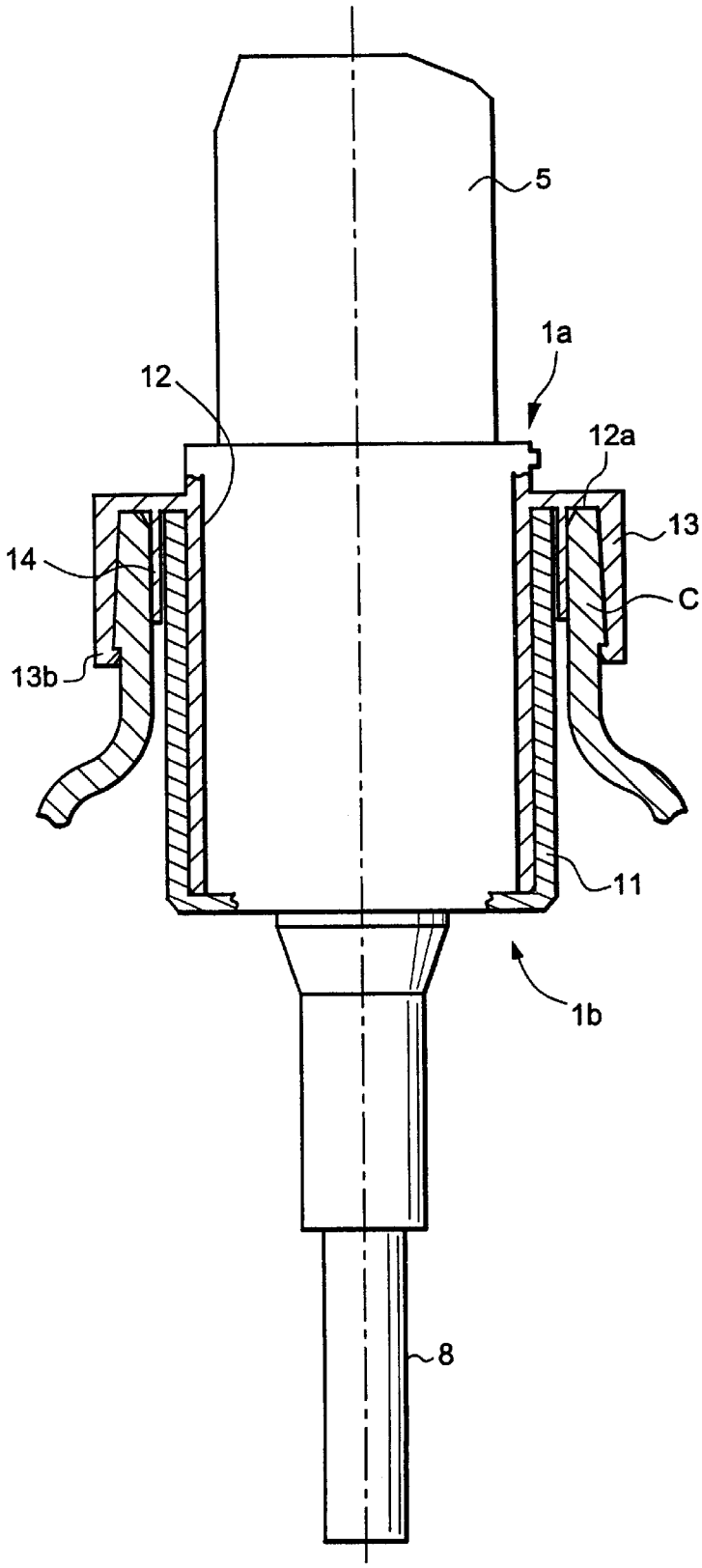

In the variants shown in FIGS. 2 and 3, the body 1 is mounted on the neck C of a receptacle.

To this end, the skirt 12 is fitted with a support and fixing collar extending the shoulder 12*a*.

In FIG. 2, the collar 13 has a thread 13*a* cooperating with complementary threads made on the outside of the neck C.

In FIG. 3, the collar 13 is provided with snap-fastening members 13b for co-operating with complementary members of the neck C.

A cylindrical partition 14 extends downwards from the shoulder 12*a* to define a first peripheral groove in which the top edge of the neck C is engaged and a second groove in which the top portion of the sleeve 11 is engaged.

The bottom portion of the sleeve 11 comes into contact in this case with the inside wall of the neck C, but it is not clamped radially thereagainst so as to make it possible to screw the dispenser onto the neck.

Figure 4:
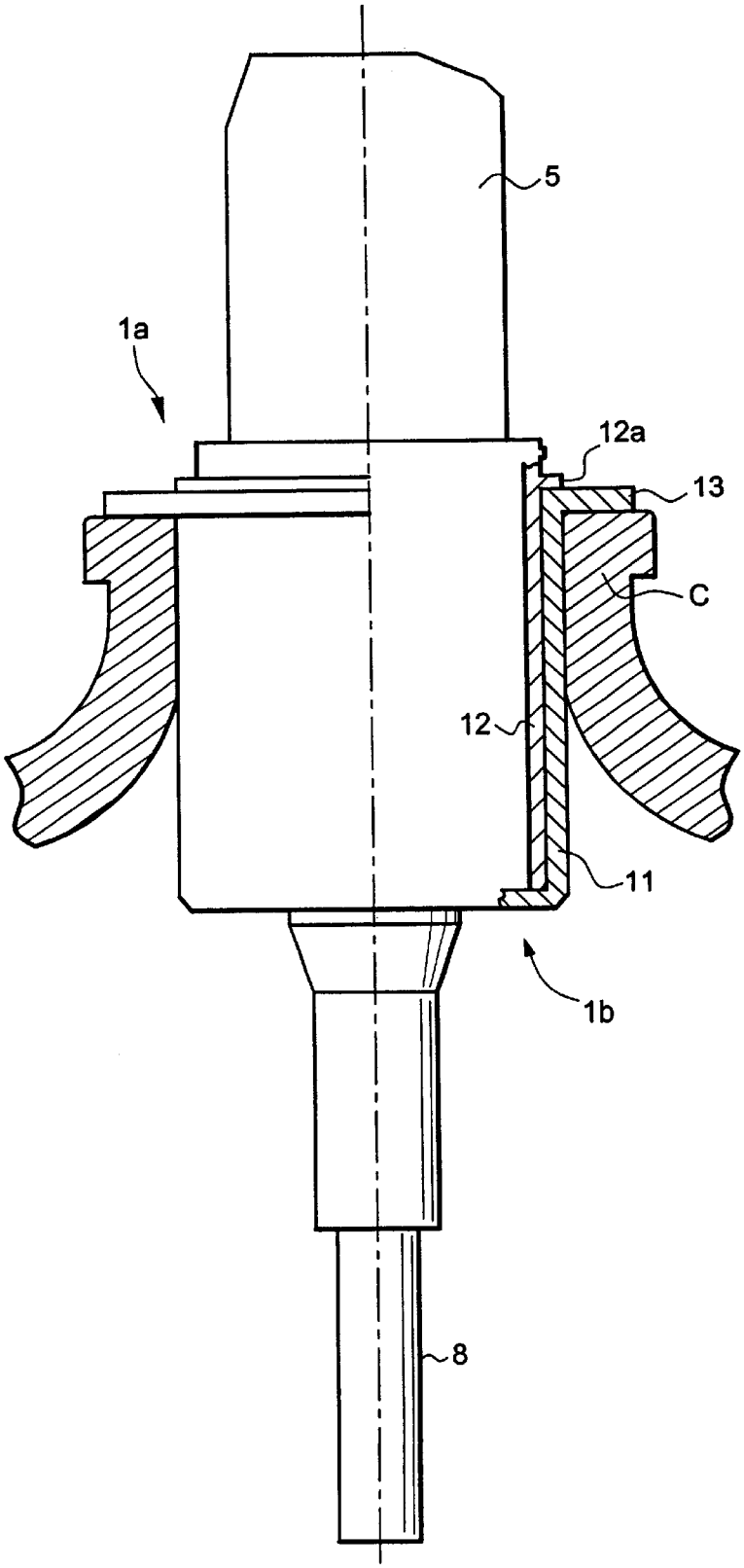

FIG. 4 shows the body 1 engaged as a push-fit in the neck C of the receptacle with leaktight radial clamping.

For this purpose, the sleeve 11 carries a collar 13 which in this case is made in the form of a single annular transverse wall which is adjusted and locked so as to be compressed between the rim of the neck C and the shoulder 12*a* of the skirt 12.

Co-operation between the rigid neck C and the skirt 12 plus sleeve 11 which are of suitable hardnesses ensures that the assembly remains locked and leaktight.

FIG. 5 shows a variant embodiment which corresponds to the body 1 being screwed onto the neck C as in the variant of FIG. 2.

However, in FIG. 5, an annular gasket J is disposed between the rim of the neck C and the collar 13.

FIG. 6 shows a variant embodiment which corresponds to the body 1 being snap-fastened to the neck C as in the variant of FIG. 3, but in this case the collar 13 is carried by the sleeve 11.

FIG. 7 shows a variant in which the bottom element is provided with a bushing 16 extending the sleeve 11 coaxially downwards and clamping radially in leaktight manner inside the neck C like a cork. In this case the collar 13 is secured to the sleeve 11 via its bottom 11*b* and serves to hold the body 1 outside the neck C. The bushing 16 is of substantially the same diameter as the skirt 12 but it extends outside the chamber 10.

Where appropriate, the collar 13 is provided with screw-fastening or snap-fastening means of the type provided in FIGS. 2, 3, 5, and 6 for locking the dispenser to the neck C.

FIG. 8 shows another variant derived from that of FIG. 7 in which the bushing 16 is associated with snap-fastening means carried by the bottom wall of the sleeve 11. In this case, the diameter of the sleeve 11 corresponds substantially to the diameter of the neck C. Consequently, the collar 13 is constituted by a portion of the bottom wall 11*b* of the sleeve 11. The body 1 is thus placed in line with the neck C and appears to run on continuously therefrom.

What is claimed is:

1. A dispenser for dispensing liquids from a receptacle having a neck, the dispenser being of the type comprising a cylindrical and conical body containing a measuring chamber closed at its bottom end by an admission valve and at its top end by a piston provided with a delivery valve and a delivery tube capped by a pushbutton, the body being the result of assembling together two independent elements comprising:

a top element carrying said piston and provided with a cylindrical skirt; and a bottom element provided with a sleeve for co-operating with said skirt by leaktight radial clamping so as to define the wall of said measuring chamber, said bottom element being provided with a bushing extending said sleeve coaxially downwards for engaging with leaktight radial clamping inside the neck of the receptacle.

2. A dispenser according to claim 1, wherein said skirt is engaged inside said sleeve.

3. A dispenser according to claim 2, wherein the bottom edge of said skirt comes into contact with the inside wall of said sleeve.

4. A dispenser according to claim 1, wherein said skirt carries a shoulder forming an abutment for the top edge of said sleeve.

5. A dispenser according to claim 1, wherein the inside wall of said skirt carries a radial projection for retaining the piston and pushbutton.

6. A dispenser according to claim 1, wherein the admission valve is carried by the bottom element being provided at the bottom portion of said sleeve.

7. A dispenser according to claim 1, wherein said sleeve or said skirt carries a support and fixing collar on the neck of the receptacle.

8. A dispenser according to claim 7, wherein said collar is provided with screw-fastening or snap-fastening members for co-operating with complementary members of the receptacle.

9. A dispenser according to claim 7 or claim 8, wherein said collar is constituted by a portion of the bottom of the sleeve.

10. A dispenser according to claim 1, wherein the inside wall of said skirt carries a radial projection for retaining the piston.

11. A dispenser according to claim 1, wherein the inside wall of said skirt carries a radial projection for retaining the pushbutton.

* * * * *